US005549399A

United States Patent [19]

Sakuragi et al.

[11] Patent Number: 5,549,399

[45] Date of Patent: Aug. 27, 1996

[54] TAPE PRINTING METHOD AND APPARATUS HAVING HORIZONTAL AND ROTATED PRINTING MODES

[75] Inventors: Shoji Sakuragi; Sachiyo Nakahigashi; Sachie Kanda; Akihiro Sawada, all of Nagoya, Japan

[73] Assignee: Brother Kogyo Kabushiki Kaisha, Nagoya, Japan

[21] Appl. No.: 531,973

[22] Filed: Sep. 21, 1995

[30] Foreign Application Priority Data

Sep. 29, 1994 [JP] Japan ..... 6-261038

[51] Int. Cl.[6] ..... B41J 5/30

[52] U.S. Cl. ..... 400/63; 400/3; 400/76; 400/586

[58] Field of Search ..... 400/63, 70, 76, 400/586, 615.2, 1, 3, 9

[56] References Cited

U.S. PATENT DOCUMENTS 4,955,089 9/1990 Altrieth, III ..... 400/76
5,044,790 9/1991 Kawamura ..... 400/76
5,188,469 2/1993 Nagao et al. .
5,322,375 6/1994 Niwa et al. ..... 400/76
5,469,514 11/1995 Kawamura ..... 400/63

FOREIGN PATENT DOCUMENTS 5-50657 3/1993 Japan .

*Primary Examiner*—John S. Hilten
*Attorney, Agent, or Firm*—Oliff & Berridge

[57] ABSTRACT

An apparatus and method of printing characters and symbols either vertically or horizontally on an elongated recording medium adjusts the position of vertically printed characters and symbols so that the vertically printed characters and symbols are evenly spaced on the recording medium. When a vertical printing is to be accomplished, dot pattern data in a data development buffer is rotated 90 degrees counter-clockwise, and transferred to a vertical data development buffer. The rotated dot pattern data for each character is then moved in the longitudinal direction of the recording medium, as necessary, to ensure that each character will be positioned in the middle of its character pitch. The longitudinal adjustment ensures that the upper and the lower margin of each character are equal.

25 Claims, 8 Drawing Sheets

Fig.8B
Fig.8A
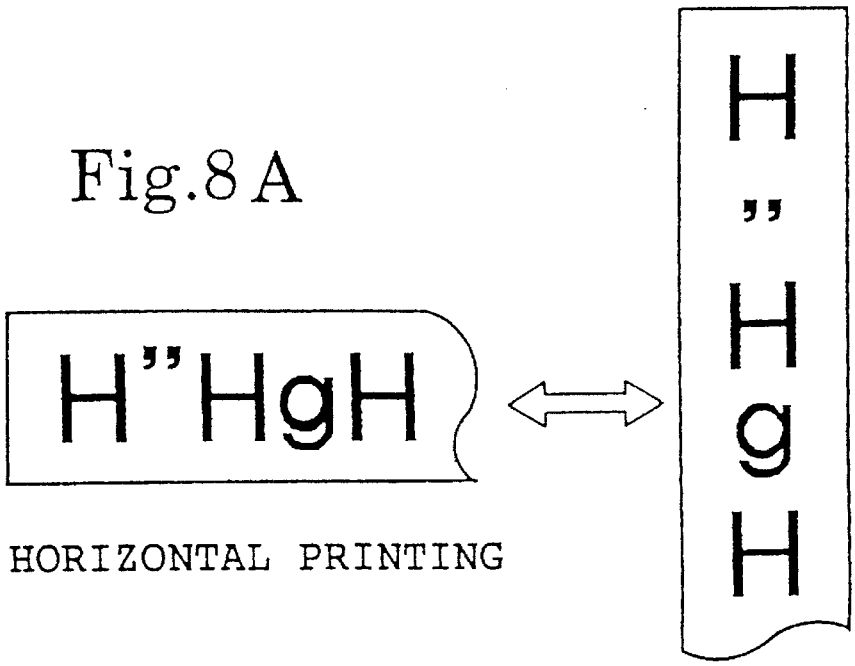
HORIZONTAL PRINTING
VERTICAL PRINTING
Fig.9B
Fig.9A
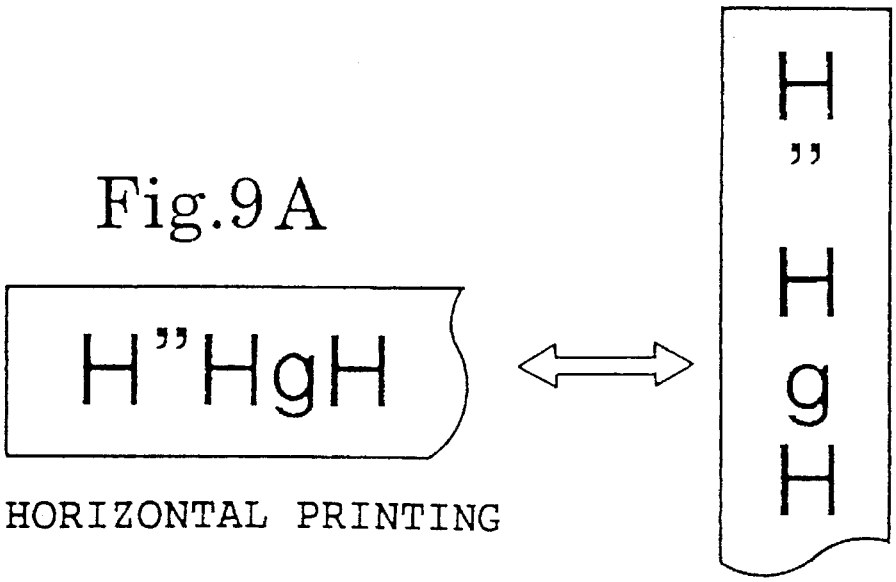
HORIZONTAL PRINTING
VERTICAL PRINTING

TAPE PRINTING METHOD AND APPARATUS HAVING HORIZONTAL AND ROTATED PRINTING MODES

BACKGROUND OF THE INVENTION

1. Field of the Invention

The present invention relates to methods and devices for printing characters and symbols on an elongated recording medium, such as an elongated tape. More particularly, the invention relates to methods and devices wherein the orientation in which characters and symbols are printed on the recording medium can be changed, and wherein the position of individual characters and symbols may be shifted along the longitudinal direction of the recording medium depending on the selected print orientation and the shape of the character or symbol such the printed characters and symbols appear evenly spaced on the recording medium.

2. Description of the Related Art

Prior art tape printing devices are capable of printing mirror images of characters, symbols, etc. onto the back of a transparent tape. The transparent tape may then be bonded to a first side of a double-sided adhesive tape, a peeling sheet being attached to the second side of the adhesive tape. When the peeling sheet is removed, the printed tape may be adhered to an object, such as a video cassette, to serve as a label. Such prior art tape printing devices generally print characters horizontally in the longitudinal direction of the tape, as shown in FIG. 9A.

Some tape printing devices, such as the one disclosed in Japanese Patent Laid-Open No. Hei 5-50657, are capable of printing in either the horizontal or the vertical direction, as shown in FIGS. 9A and 9B, respectively.

A conventional tape printing device prints vertically oriented characters by simply rotating the individual characters 90 degrees on the tape surface. Because certain characters are not located in the middle of the tape width when printed horizontally, when such characters are rotated 90 degrees, the characters are not evenly spaced along the tape. For instance, during horizontal printing, the character g is printed slightly lower than the middle of the tape width, and the symbol " is printed slightly higher than the middle of the tape width. During vertical printing where the characters are simply rotated 90 degrees, the character g is printed slightly lower than the middle of its two adjacent characters, and the symbol" is printed slightly higher than the middle of its two adjacent characters, as illustrated in FIG. 9B. The irregular character spacing is unsightly and unattractive.

SUMMARY OF THE INVENTION

It is an object of the present invention to overcome the above and other deficiencies of the prior art and to provide a tape printing method and device capable of printing evenly spaced vertically oriented characters on an elongated recording medium.

A tape printing device embodying the invention may include data input means for inputting characters and symbols; storing means for storing dot pattern data of individual characters and symbols; text generating means for generating text using stored dot pattern data; printing means for printing the contents of the text onto an elongated recording medium; print orientation indicator means for indicating a selected print orientation; character rotating means for rotating the dot pattern data if the characters are to be printed vertically; and character position moving means for shifting the print position of individual characters so that the characters appear evenly spaced on the recording medium.

A user of a tape printing device embodying the invention may enter characters and symbols to be printed on an elongated recording medium using the data input means. The user may also set the printing orientation flag (to select either horizontal or vertical printing) using the data input means. When vertical printing has been selected, the dot pattern data for characters is rotated by the character rotating means, and the character position moving means shifts the printing position of the rotated dot pattern data, as necessary, to ensure that the vertically oriented characters are evenly spaced on the recording medium.

These and other objects, features and advantages of the invention will become more apparent upon a reading of the following description and the appended drawings.

BRIEF DESCRIPTION OF THE DRAWINGS

Preferred embodiments of the present invention will be described in detail with reference to the following figures, wherein:

FIG. 8A is a view showing characters printed horizontally on an elongated recording medium;

FIG. 8B is a view showing how characters may be printed vertically on an elongated recording medium by an device embodying the invention;

FIG. 9A is a view showing characters printed horizontally by a conventional printing device; and FIG. 9B is a view showing characters printed vertically by a conventional printing device.

DETAILED DESCRIPTION OF PREFERRED EMBODIMENTS

Preferred embodiments of the invention will now be described with reference to the accompanying drawings. A printing device embodying the invention may be used to print many kinds of characters such as hiragana, kanji, symbols and alphanumeric characters onto an elongated recording medium. Although the invention is described with reference to a device that generates a label with an adhesive backing, this example is not intended to be in any way limiting. The invention is applicable to any method or device for vertical printing of characters and symbols on an elongated recording medium.

Figure 1:
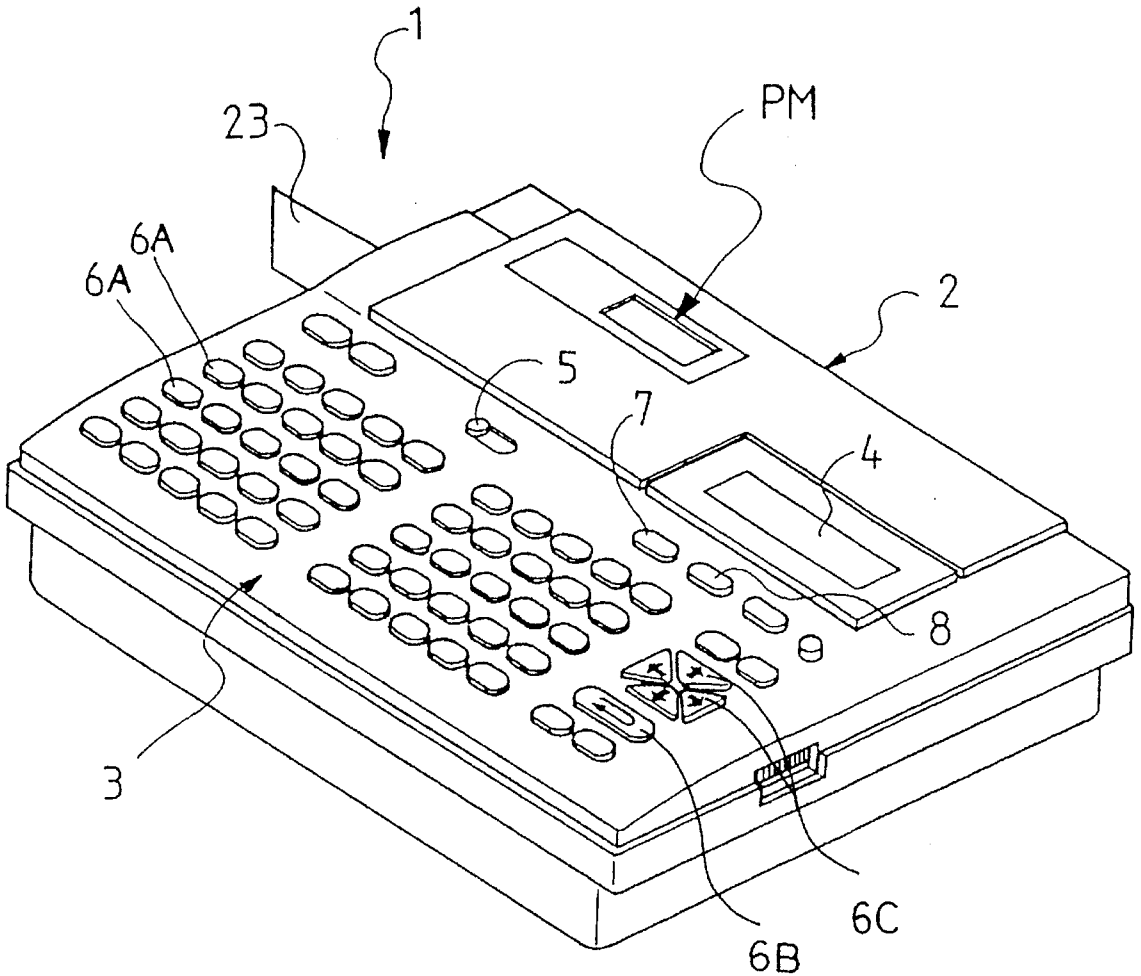
FIG. 1 is a perspective view of a tape printing device embodying the invention.

As shown in FIG. 1, a printing device 1 embodying the invention includes a keyboard 3, mounted on a body frame 2. A thermal printing mechanism PM is also mounted on the body frame 2. A liquid crystal display (LCD) 4 is mounted adjacent the keyboard 3. The LCD 4 displays, in a plurality of lines, the characters input by various keys located on the keyboard 3.

The keyboard 3 contains a knob 5 that can be operated to open a cover of the thermal printing mechanism PM. The keyboard 3 may also includes a plurality of character keys 6A for inputting characters such as hiragana, symbols and alphanumeric characters; a return key 6B; cursor moving keys 6C for moving a cursor vertically and horizontally on the screen; an enter/recall key for entering and recalling character strings such as phrases and idioms; edit keys such as an execute key and a delete key; a vertical print setting key 7 for setting vertical printing; a print key 8 for designating printing; and a power switch for turning power on and off.

Figure 2:
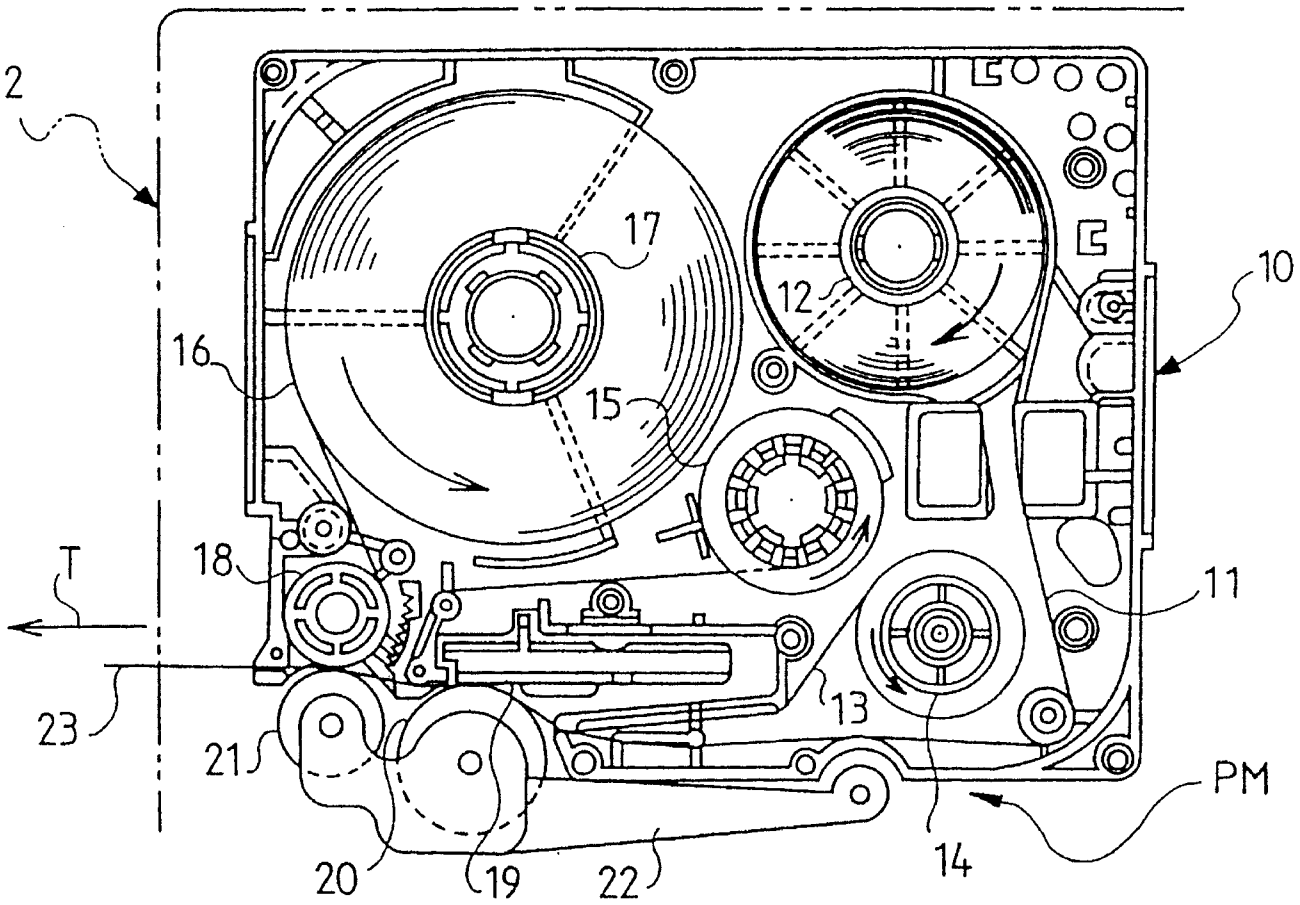
FIG. 2 is a plan view of a tape cassette mounted on a portion of the tape printing device that houses the tape cassette.

The thermal printing mechanism PM will now be described briefly with reference to FIG. 2. A rectangular tape cassette 10 is detachably mounted on the thermal printing mechanism PM. The tape cassette 10 comprises a tape spool 12 having a laminate tape 11 (the recording medium) wound therearound, a ribbon spool 14 with an ink ribbon 13 wound therearound, a ribbon take-up spool 15 for taking up the ink ribbon 13, a feed spool 17 having a double-sided adhesive tape 16 fitted with a peeling paper on a first side wound therearound, and a bonding roller 18 for bonding together the laminate tape 11 and the double-sided adhesive tape 16. The spools and the roller are all rotatably mounted on the cassette.

A thermal print head 19 is mounted adjacent the location where the laminate tape 11 and the double-sided adhesive tape 16 are bonded together. A platen roller 20 pushes the laminate tape 11 and ink ribbon 13 onto the thermal print head 19, and a feed roller 21 feeds the bonded printed tape 23 (comprised of the laminate tape 11 and the double-sided adhesive tape 16) by pushing the laminate tape 11 and double-sided adhesive tape 16 against the bonding roller 18. The platen roller 20 and feed roller 21 are each rotatably mounted on a roller support member 22, which in turn is pivotally mounted to the body frame 2. The thermal print head 19 has a plurality of heating elements furnished vertically thereon.

In operation, a tape feed motor is driven in a predetermined direction to rotate the bonding roller 18 and ribbon take-up spool 15 in synchronism. When a plurality of heating elements on the thermal print head 19 are powered, characters, symbols, etc. are printed in mirror images, in the form of dot columns, onto the back of the laminate tape 11. The double-sided adhesive tape 16 is bonded onto the back of the laminate tape 11 to produce the printed tape 23. The printed tape 23 is fed in a tape feed direction T to the outside of the body frame 2, as illustrated in FIGS. 1 and 2. More details of the thermal printing mechanism PM are disclosed in U.S. Pat. No. 5,188,469, the disclosure of which is hereby incorporated by reference.

Figure 3:
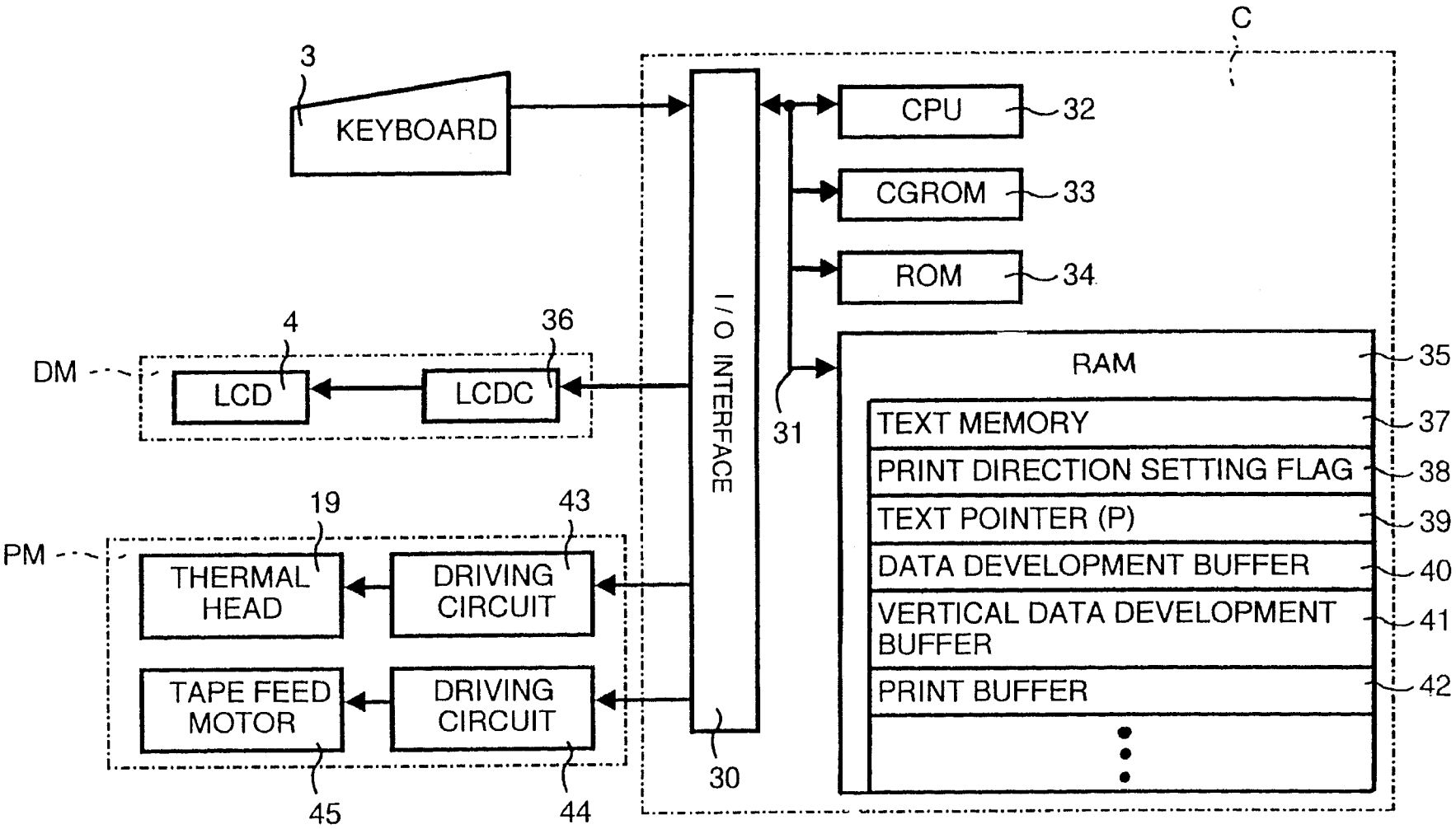
FIG. 3 is a block diagram of a tape printing device embodying the invention.

The control section of the tape printing device 1 will now be described with reference to FIG. 3. FIG. 3 is a block diagram showing the major portions of the tape printing device 1. The control section is comprised primarily of a control unit C, the keyboard 3, the thermal printing mechanism PM, and a display mechanism DM. The keyboard 3, thermal printing mechanism PM and display mechanism DM are connected to the control unit C via an I/O interface 30.

The control unit C has a CPU 32 housed therein as its nucleus. The CPU 32 is connected to the I/O interface 30 via a bus 31. The CPU 32 is further connected to a CGROM 33, a ROM 34 and a RAM 35 via the bus 31.

The CPU 32 performs various computations needed to control the tape printing device 1 using programs stored in the ROM 34. Such programs include a text preparation program for preparing text in a text memory 37 (to be described below) using dot pattern data representing characters that may be input from the keyboard 3; a display control program for controlling a display controller 36 so as to display characters and the like on an LCD 4; a print control program for driving the thermal print head 19 and tape feed motor 45 to accomplish printing of text on a recording medium; and other programs necessary for control over the tape printing device 1. A description of the print control program is described below with reference to FIGS. 4, 5 and 6.

The CGROM 33 of the control unit C stores dot pattern data corresponding to various characters and symbols.

The RAM 35 of the control unit C includes a plurality of areas that temporarily store the results of various computations carried out by the CPU 32. Those areas include a text memory 37 for storing code data of characters or symbols input by a user; a print orientation setting flag 38 for indicating whether vertical (flag on) or horizontal (flag off) printing has been selected; a text pointer 39 for successively pointing to the code data of individual characters or symbols stored in the text memory 37; a data development buffer 40 for storing dot pattern data read from the CGROM 33 based on the code data stored in the text memory 37; a vertical data development buffer 41 used to store rotated dot pattern data used for vertical printing; a print buffer 42 for storing character dot pattern data that is to be sent to the printing mechanism PM; and other areas necessary for controlling the tape printing device 1.

The display mechanism DM of FIG. 3 comprises the display controller (LCDC) 36 and the display device (LCD) 4. The LCDC 36 is connected to the I/O interface 30. The LCD 4 displays characters, symbols and the like under control of the LCDC 36, which in turn is controlled by the control unit C.

The thermal printing mechanism PM in the control section of FIG. 3 causes the thermal printing head 19 and the tape feed motor 45 to work in cooperation to print characters on a recording tape. The thermal printing head 19 is driven by a driving circuit 43 based on print data sent from the print buffer 42 of the RAM 35 through the I/O interface 30 in the control unit C. The tape feed motor 45 is driven by a driving circuit 44 in like manner.

The keyboard 3 serves not only to input characters and the like, but also to issue various commands to the control unit C via the I/O interface 30, as mentioned above.

Figure 4:
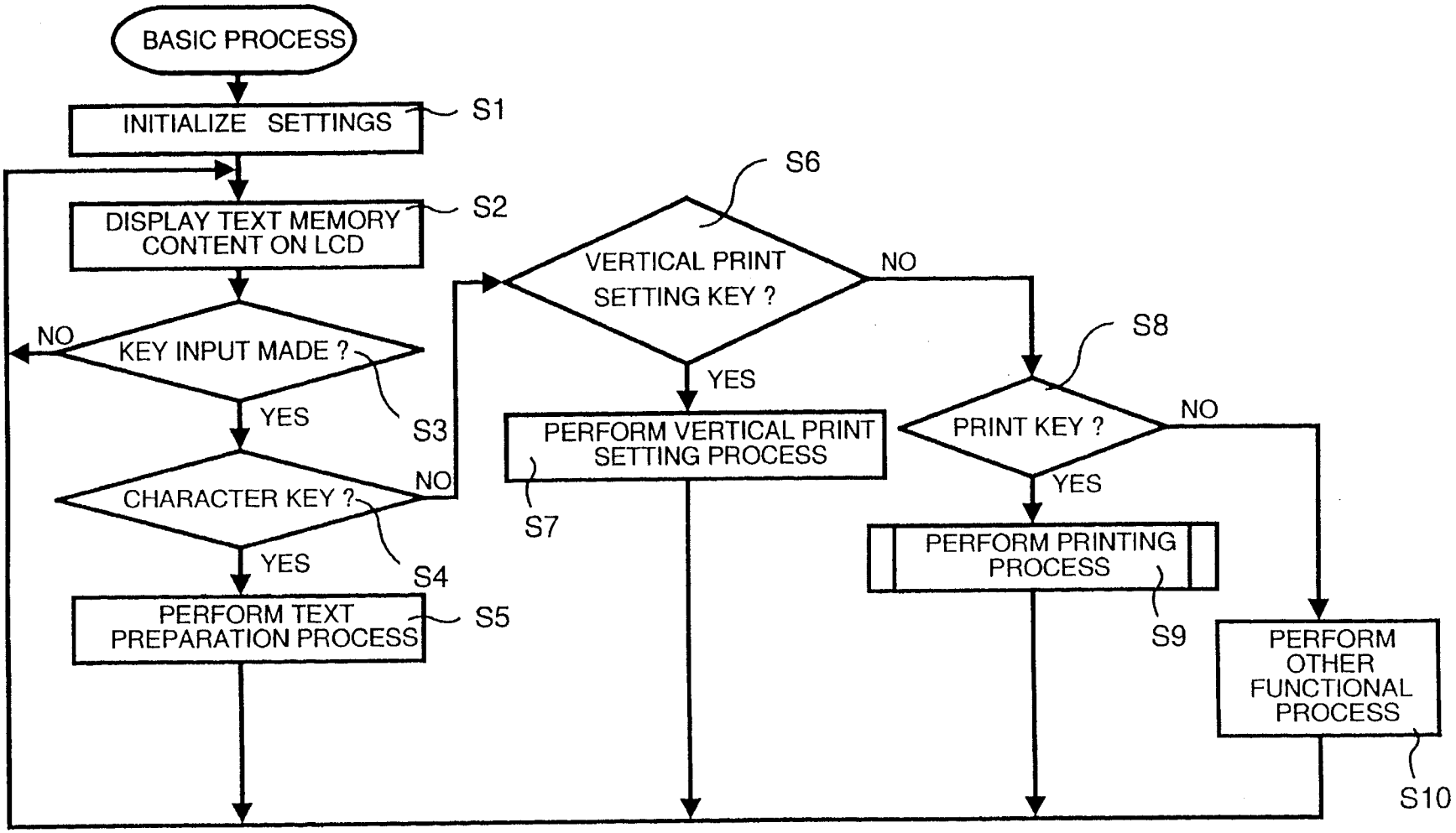
FIG. 4 is a flowchart of a basic control process that may be carried out by a tape printing device embodying the invention.
Figure 5:
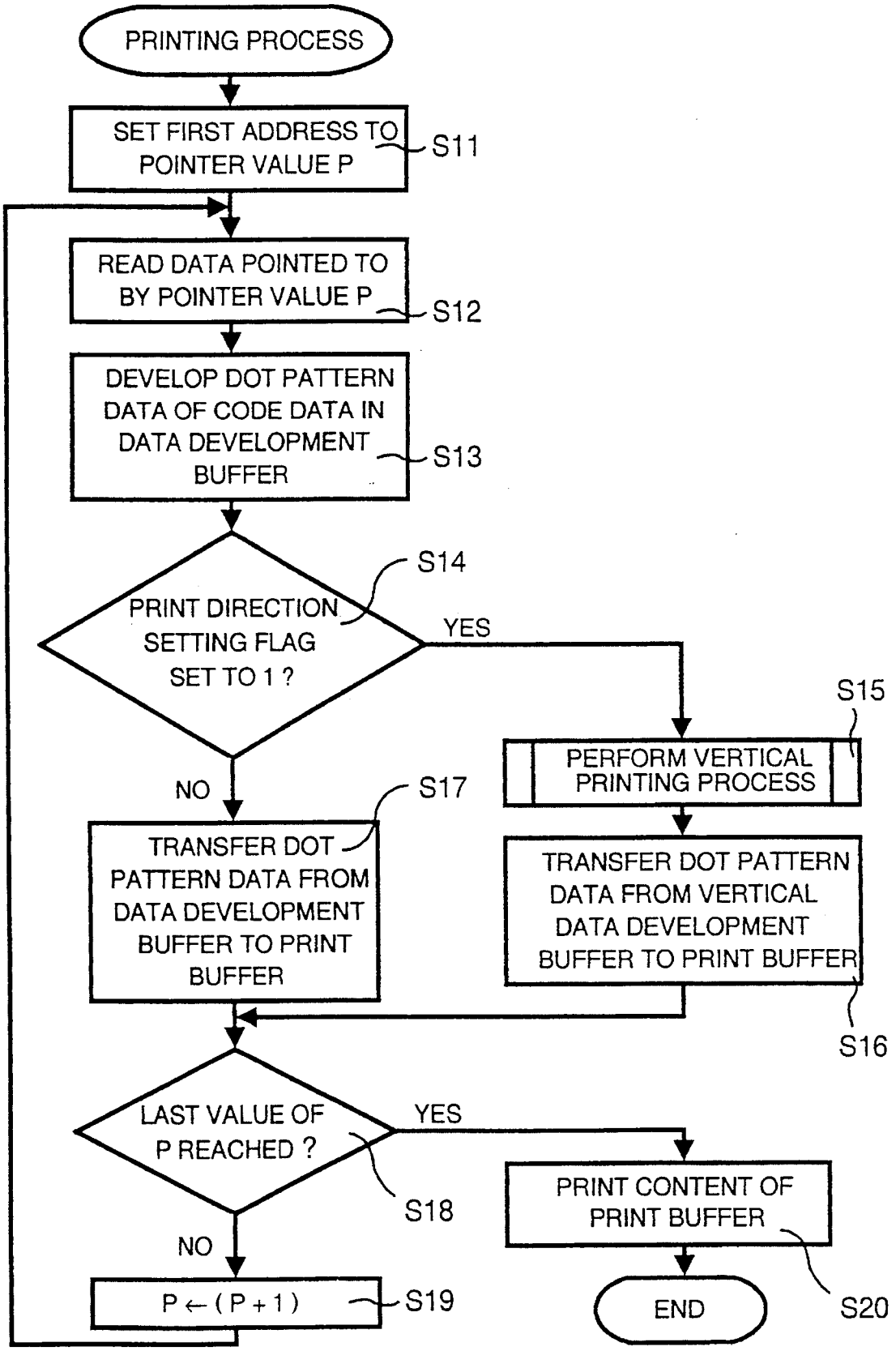
FIG. 5 is a flowchart of a printing process that may be performed by a tape printing device embodying the invention.
Figure 6:
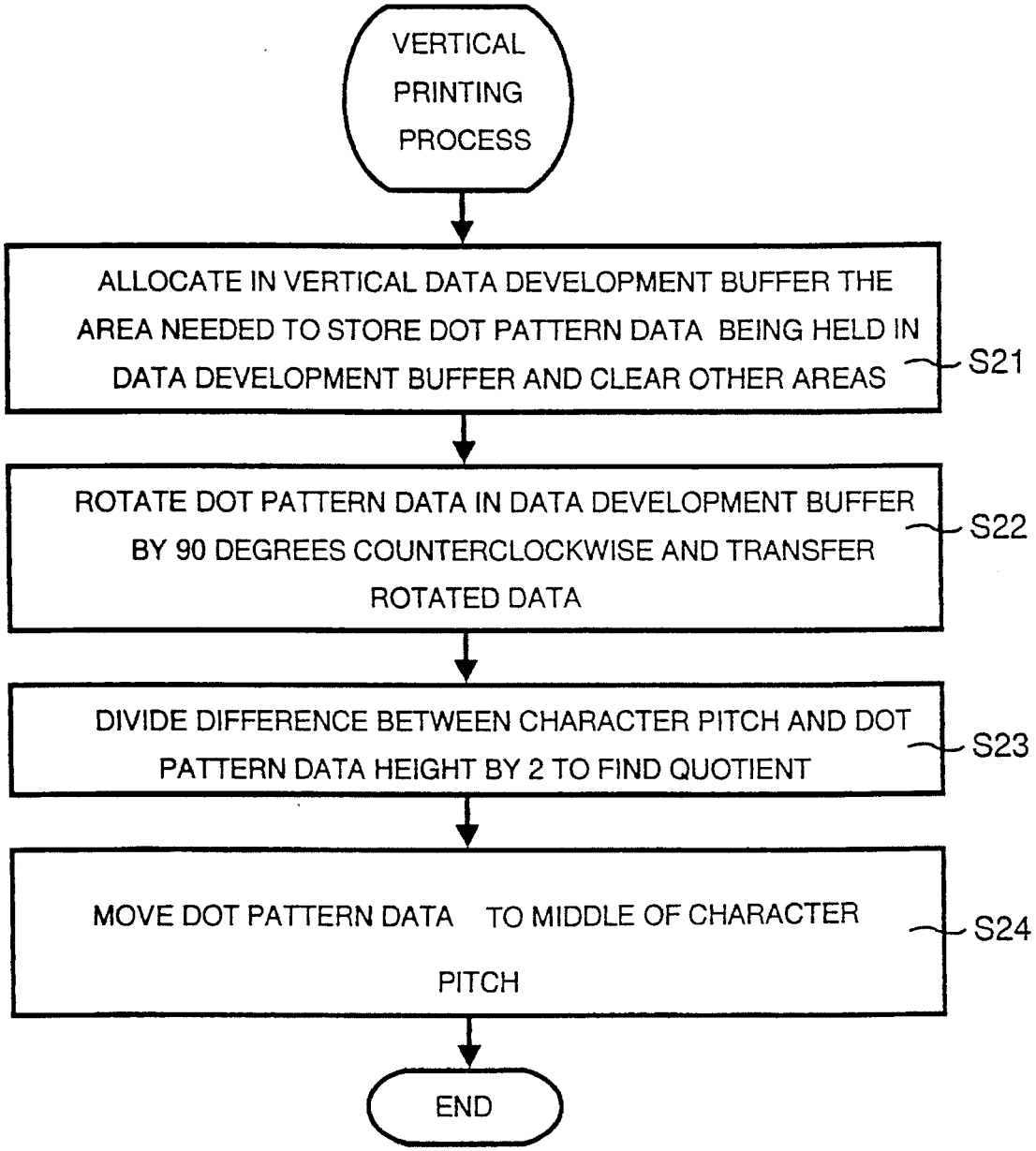
FIG. 6 is a flowchart of a vertical printing process that may be performed by a tape printing device embodying the invention.

The basic process carried out by the tape printing device 1 will now be described with reference to the block diagram shown in FIG. 3, and the flowcharts shown in FIGS. 4, 5 and 6. The basic process of the tape printing device 1 is started by turning on the power switch, and is terminated by turning off power switch.

When the power switch is turned on the control process starts in step (hereinafter referred to as "S") 1. In S1, the LCD 4, the text memory 37, the print orientation setting flag 38 and the print buffer 42 are all initialized, and the basic process status is reached. In S2, the content of the text memory 37 is displayed on the LCD 4. Immediately after power is turned on, the text memory 37 is clear, and no characters or symbols are displayed.

S2 is followed by S3, in which a check is made to see if a key has been actuated by a user. If no key has been actuated ("NO" in S3), the process returns to S2, and the contents of the text memory 37 is again displayed. If a key has been actuated ("YES" in S3), the process continues to S4.

In S4, a check is made to see if the actuated key was a character key. If the actuated key was a character key ("YES" in S4), the process continues to S5. In S5, the code data corresponding to the actuated character key 6 is stored in the text memory 37 for text preparation, and the process returns to S2, wherein the entered character is displayed on the LCD 4. If the actuated key is not found to be a character key in S4 ("NO" in S4), the process continues to S6.

In S6, a check is made to see if the actuated key was the vertical print setting key. If the actuated key was the vertical print setting key 7 ("YES" in S6), the process continues to S7. If the operated key is not found to be the vertical print setting key in S6 ("NO" in S6), the process continues to S8.

If the actuated key was the vertical print setting key, in S7, a vertical print setting process is carried out wherein the print orientation setting flag 38 in the RAM 35 is set to 1 (flag on). When the print orientation setting flag is set to 1 (flag on), vertical printing may be performed. When the print orientation setting flag 38 is set to 0 (flag off) horizontal printing may be performed. The process then returns to S2, where the characters stored in the text memory 37 are displayed on the LCD 4.

If the actuated key was not the vertical print setting key, in S8, a check is made to see if the actuated key was the print key. If the actuated key was the print key 8 ("YES" in S8), the process continues to S9. If the actuated key was not the print key in S8 ("NO" in S8), the process continues to S10, where a functional process corresponding to the actuated key is carried out. In S9, a printing process described in detail below is carried out. After either the printing process of S9, or the other functional process of S10 has been carried out, the process returns to S2.

The printing process of S9 will now be described in more detail with reference to the flowchart shown in FIG. 5. In the first step of the printing process, S11, the first address of the code data in the text memory 37 is set to the pointer value P of the text pointer 39. In S12, that code data in the text memory 37 which is pointed to by the pointer value P is read.

In S13, the dot pattern data in the CGROM 33 that corresponds to the code data read in S12 is developed and stored in the appropriate memory area of the data development buffer 40. In S14, a check is made to see if vertical printing has been selected by checking the status of the print orientation setting flag. If the print orientation setting flag 38 is set to 1 to indicate that vertical printing has been selected ("YES" in S14), the process continues to S15. If the print orientation setting flag 38 is set to 0 to indicate that horizontal printing has been selected, the process continues to S17.

If vertical printing has been selected, a vertical printing data manipulation process is performed in S15. This data manipulation process is described in detail below. After the data manipulation process of S15 is completed, the process continues to S16. In S16, the dot pattern data which is processed for vertical printing and held in the vertical data development buffer 41 is transferred to the print buffer 42. The process then continues to S18.

If, in S14 it is found that the print orientation setting flag 38 is set to 0 ("NO" in S14), the dot pattern data placed into the data development buffer 40 in S17 is transferred directly to the print buffer 42, and the process continues to S18.

In S18, a check is made to see if a pointer value P of the text pointer 39 has reached the last value. If the last value has not yet been reached ("NO" in S18), the process continues to S19. In S19, the pointer value P is incremented by 1, and the process returns to S12. If the point value P is found to have reached the last value ("YES" in S18), the process continues to S20.

In S20, the contents of the print buffer 42 is printed by the thermal printing mechanism PM, and the printing process is terminated. As described above, after the printing process is completed, the process returns to S2.

The data manipulation process of S15 will now be described with reference to the flowchart shown in FIG. 6. In S21, the area needed to store the dot pattern data being held in the data development buffer 40 is allocated in the vertical data development buffer 41, and the other areas are cleared. The process then continues to S22.

In S22, the dot pattern data in the data development buffer 40 is rotated counterclockwise by 90 degrees, and the rotated data is transferred to the vertical data development buffer 41, where the dot pattern data is prepared for vertical printing.

Figure 7A:
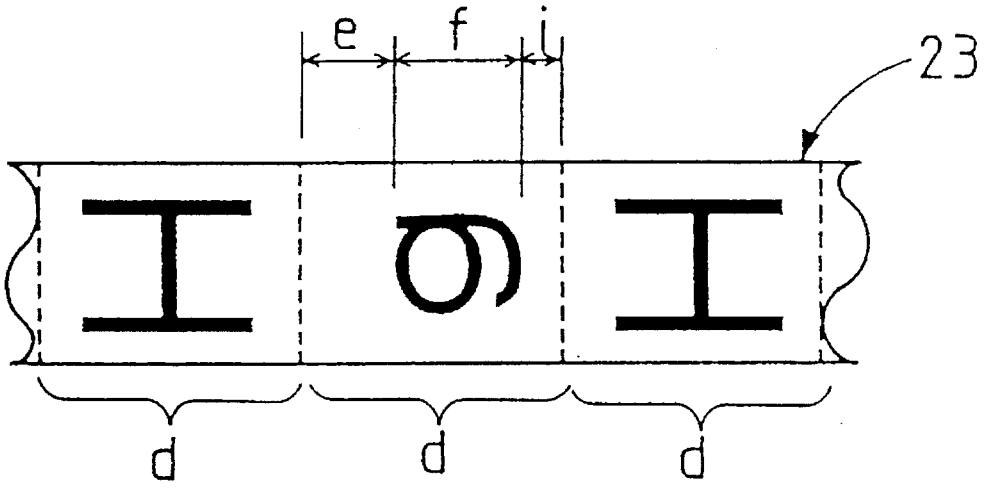
FIG. 7A is a view showing characters printed vertically on an elongated recording medium.
Figure 7B:
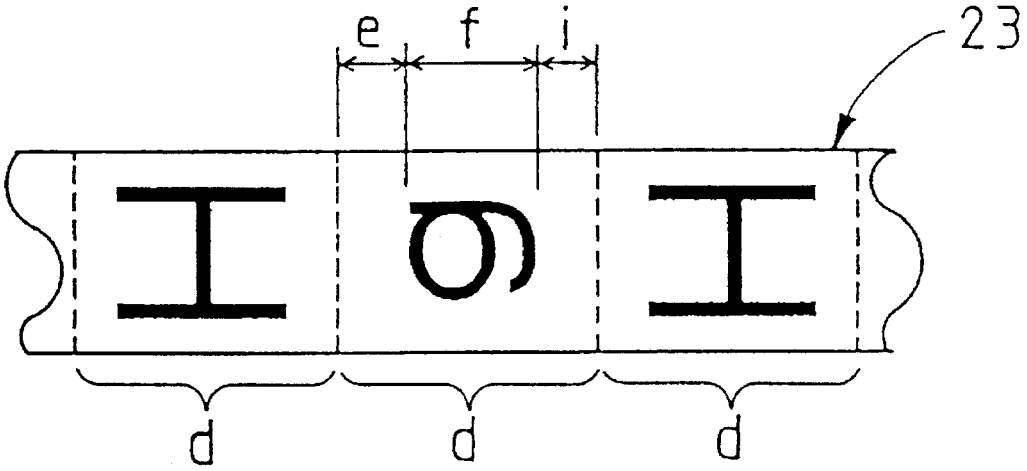
FIG. 7B is another view showing characters printed vertically on an elongated recording medium.

FIGS. 7A and 7B show characters that have been printed vertically on an elongated recording tape 23. Broken lines on the tape 23 indicate a character pitch d; they are shown here for explanation purposes and are not printed in practice.

As shown in FIG. 7A, when the dot pattern data representing the character g is rotated 90 degrees counterclockwise in the vertical data development buffer 41 (in S22), the upper margin e of the printed character becomes greater than the lower margin i. The character g is thus slightly dislodged from the middle of the character pitch d. In S23, a difference between the character pitch d and the dot pattern data height is calculated. The difference is then divided by 2 to find a quotient. The quotient is then used as equal sized upper and lower margins, e and i, respectively. The margins are used to position the dot pattern data of the character in the middle of the character pitch d.

In S24, the dot pattern data rotated by 90 degrees counterclockwise (in FIG. 7A) is moved in the longitudinal direction of the tape by an amount required to make the upper and lower margins, e and i, equal in size. This operation is carried out to position the rotated dot pattern data in the middle of the character pitch d.

FIG. 7B shows the vertically printed characters after the character g has been moved longitudinally to center it between its two adjacent characters. If, after a character is rotated 90 degrees counterclockwise, the top and bottom margins are already equal, the dot pattern data representing the character in the vertical data development buffer 41 remains unmoved longitudinally along the tape.

After the dot pattern data has been rotated and adjusted as described above, the process continues to S16, as described above.

FIGS. 8A and 8B show how printing is performed according to the invention. For vertical printing, as described above, the horizontally arranged characters shown in FIG. 8A are rotated by 90 degrees, and the dot pattern data for each character is shifted, as necessary, to position the character in the middle of its character pitch. Because the printed characters and symbols are evenly spaced in the longitudinal direction of the tape, the resulting tape is attractive and has a pleasing appearance.

Although the above description contains many specificities, these should not be construed as limiting the scope of the invention but as merely providing illustrations of the presently preferred embodiments of this invention.

For example, although in the above-described embodiment the dot pattern data is rotated 90 degrees counterclockwise for vertical printing, the dot pattern data may be rotated any desired angle to allow for the printing of diagonally oriented characters. In this case, too, the characters and symbols may be positioned in the middle of the character pitch in the longitudinal direction of the tape to produce evenly spaced text. The resulting tape also has a pleasing appearance.

In addition, in alternate devices embodying the invention, both horizontal and rotated dot pattern data may be stored in the CGROM. In this instance, after the user selects the desired type of printing (horizontal or rotated), the device will develop the corresponding type of dot pattern data from the CGROM into text data suitable for printing and store this text data in the print buffer. In such a device, the rotated dot pattern data stored in the CGROM may already be centered in the character pitch so that the adjusting step need not be performed.

In yet additional embodiments of the invention, the data development data buffer and the vertical data development buffer, as described above, may be eliminated. In this device, the dot pattern data may be read from the CGROM, developed into text data, rotated, adjusted in the character pitch, then immediately stored in the print buffer. Such a device would require less RAM memory that a device that uses a data development buffers, and the printing process may be accomplished more rapidly because certain data reading and storing steps are eliminated.

Furthermore, although in the above-described embodiment the print orientation setting flag is used to determine the orientation of all of the characters stored in the text memory, alternative embodiments of the invention may be provided with a print orientation setting flag for each of the various characters and symbols stored in the text memory. This alternative would allow a user to set diverse print directions for a single printing process, while keeping each of the rotated characters positioned in the middle of its character pitch.

Thus, the scope of the invention should be determined by the appended claims and their legal equivalents, rather than by the embodiments described herein.

What is claimed is:

1. A method of printing characters on an elongated recording medium, comprising the steps of:

inputting at least one character or symbol for printing;

setting at least one of horizontal and rotated printing modes;

reading horizontally oriented dot pattern data corresponding to the at least one character or symbol from a memory;

rotating the dot pattern data corresponding to the at least one character or symbol a predetermined amount when the rotated printing mode is set;

shifting the position of the rotated dot pattern data to position the rotated dot pattern data for the at least one character or symbol in the center of a character pitch corresponding to the at least one character or symbol when the rotated printing mode is set; and printing the dot pattern data corresponding to the at least one character or symbol on an elongated recording medium.

2. The method of claim 1, wherein the step of printing the dot pattern data corresponding to the at least one character or symbol comprises printing dot pattern data stored in a printing data buffer, and wherein the method further comprises the steps of:

storing the horizontally oriented dot pattern data corresponding to the at least one character or symbol in the printing data buffer when the horizontal printing mode is set; and storing the rotated and shifted dot pattern data corresponding to the at least one character or symbol in the printing data buffer when the rotated printing mode is set.

3. The method of claim 1, wherein when the rotated printing mode is set, the step of setting the rotated printing mode further comprises selecting an amount of angular rotation, and wherein the step of rotating the dot pattern data a predetermined amount comprises rotating the dot pattern data the selected angular amount.

4. The method of claim 1, wherein the step of inputting at least one character or symbol for printing comprises inputting a plurality of characters or symbols for printing, and wherein the step of setting at least one of horizontal and rotated printing modes comprises setting at least one of horizontal and rotated printing modes for each of the plurality of characters or symbols.

5. The method of claim 4, wherein when the rotated printing mode is set for a character or symbol, the step of setting the rotated printing mode further comprises setting an amount of angular rotation, and wherein the step of rotating the dot pattern data a predetermined amount comprises rotating the dot pattern data the selected angular amount.

6. The method of claim 1, further comprising the step of storing the dot pattern data corresponding to the at least one character or symbol in a development data buffer, and wherein the step of rotating the dot pattern data corresponding to the at least one character or symbol also comprises includes reading the dot pattern data from the development data buffer.

7. The method of claim 6, further comprising the step of storing the rotated dot pattern data in a rotated development data buffer, and wherein the step of shifting the position of the rotated dot pattern data also comprises reading the rotated dot pattern data from the rotated development data buffer.

8. The method of claim 1, wherein the step of shifting the position of the rotated dot pattern data comprises the steps of:

determining a height of a character pitch;

determining a height of the rotated dot pattern data;

determining a difference between the height of the rotated dot pattern data and the height of the character pitch;

determining top and bottom character margins that are equal to one half of the difference between the height of the rotated dot pattern data and the height of the character pitch; and shifting the position of the rotated dot pattern data, if necessary, so that the determined top and bottom margins are provided above and below the character, respectively, in the character pitch.

9. The method of claim 1, wherein the step of shifting the position of the rotated dot pattern data comprises shifting the position of the rotated dot pattern data, if necessary, such that equal sized margins are provided above and below the rotated dot pattern data within the corresponding character pitch.

10. The method of claim 9, wherein the equal sized margins are determined based on a height of a character pitch and a height of the rotated dot pattern data.

11. A tape printing device comprising:

character data storing means for storing horizontally oriented dot pattern data corresponding to characters and symbols;

character inputting means for inputting at least one character or symbol for printing;

print orientation setting means for setting one of a horizontal printing mode wherein the at least one character or symbol is printed in a horizontal orientation and a rotated printing mode wherein the at least one character or symbol is printed in an orientation that is rotated relative to the horizontal orientation;

text generating means for reading the horizontally oriented dot pattern data corresponding to the at least one character or symbol from the character data storing means, and for generating text data corresponding to the at least one character or symbol, the text generating means comprising:

character rotating means for rotating the dot pattern data read from the character data storing means a predetermined amount when the rotated printing mode is set; and character position shifting means for shifting the position of the rotated dot pattern data so that the rotated dot pattern data is located in the middle of a corresponding character pitch when the rotated printing mode is set; and printing means for printing the generated text data on an elongated printing medium.

12. The device of claim 11, further comprising printing data storing means for storing text data that is to be printed, wherein the text generating means also stores the generated text data corresponding to the at least one character or symbol in the printing data storing means.

13. The device of claim 12, wherein the text generating means generates and stores horizontally oriented text data in the printing data storing means when the horizontal printing mode is set.

14. The device of claim 11, wherein the print orientation setting means is capable of setting a printing mode for each of a plurality of input characters or symbols.

15. The device of claim 11, wherein the character rotating means rotates the dot pattern data read from the character data storing means 90 degrees when the rotated printing mode is set.

16. The device of claim 11, further comprising a rotation amount setting means for setting the predetermined amount that the character rotating means rotates the dot pattern data corresponding to the at least one character or symbol.

17. The device of claim 11, wherein the character position shifting means shifts the position of the rotated dot pattern data so that equal sized top and bottom margins are provided above and below, respectively, the rotated dot pattern data in the corresponding character pitch.

18. The device of claim 17, wherein the equal sized margins are determined based on a height of a character pitch and a height of the rotated dot pattern data.

19. A tape printing device comprising:

a character data memory for storing horizontally oriented dot pattern data corresponding to characters and symbols;

an input device for inputting at least one character or symbol that is to be printed on an elongated printing medium;

a print orientation setting device for setting at least one of a horizontal printing mode wherein the at least one character or symbol is printed in a horizontal orientation, and a rotated printing mode wherein the at least one character or symbol is printed in an orientation that is rotated with respect to the horizontal orientation;

a text data generator for reading dot pattern data corresponding to the at least one character or symbol from the character data memory, for rotating the dot pattern data when the rotated printing mode is set, for adjusting the position of the rotated dot pattern data so that the rotated dot pattern data is located in the center of a corresponding character pitch when the rotated printing mode is set, and for generating text data for the at least one character or symbol; and a printer for printing the generated text data on an elongated printing medium.

20. The device of claim 19, further comprising a printing data buffer for storing generated text data that is to be printed, wherein the text generator also stores generated text in the printing data buffer.

21. The device of claim 19, wherein the text generator adjusts the position of the rotated dot pattern data so that equal sized upper and lower margins are provided above and below, respectively, the rotated dot pattern data in the corresponding character pitch.

22. The device of claim 21, wherein the equal sized margins are determined based on a height of a character pitch and a height of the rotated dot pattern data.

23. A tape printing device comprising:

character inputting means for inputting at least one character or symbol for printing;

character data storing means for storing vertically oriented dot pattern data corresponding to characters and symbols;

text generating means for reading dot pattern data corresponding to the at least one character or symbol from the character data storing means;

character position adjusting means for adjusting the position of the read dot pattern data so that the dot pattern data for each at least one character or symbol is located in the center of a corresponding character pitch; and printing means for printing the adjusted dot pattern data corresponding to the at least one character or symbol on an elongated printing medium.

24. The tape printing device of claim 23, wherein the character data storing means also comprises means for storing horizontally oriented dot pattern data corresponding to characters and symbols, the tape printing device further comprising:

print orientation setting means for setting one of a horizontal printing mode wherein the at least one character or symbol is printed in a horizontal orientation and a vertical printing mode wherein the at least one character or symbol is printed in a vertical orientation, and wherein the text generating means reads horizontally oriented dot pattern data corresponding to the at least one character or symbol from the character data storing means when the horizontal printing mode is set, and wherein the text generating means reads vertically oriented dot pattern data corresponding to the at least one character or symbol from the character data storing means when the vertical printing mode is set.

25. The device of claim 24, wherein the print orientation setting means is capable of setting a print orientation for each at least one character or symbol.

* * * * *